US006675899B2

(12) United States Patent
Coats

(10) Patent No.: US 6,675,899 B2
(45) Date of Patent: Jan. 13, 2004

(54) SELF-ERECTING RIG

(75) Inventor: E. Alan Coats, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 43 days.

(21) Appl. No.: 10/020,367

(22) Filed: Dec. 12, 2001

(65) Prior Publication Data

US 2002/0100619 A1 Aug. 1, 2002

Related U.S. Application Data

(60) Provisional application No. 60/256,049, filed on Dec. 15, 2000.

(51) Int. Cl.[7] ..... E21B 7/02

(52) U.S. Cl. ..... 166/379; 166/85.1; 175/162

(58) Field of Search ..... 166/378, 379, 166/77.51, 85.1; 175/85, 162, 52, 220

(56) References Cited

U.S. PATENT DOCUMENTS 4,821,816 A * 4/1989 Willis ..... 175/57
4,899,832 A 2/1990 Bierscheid, Jr. ..... 173/23
5,248,005 A * 9/1993 Mochizuki ..... 175/85
5,407,302 A 4/1995 Springett et al. ..... 405/196
5,704,427 A * 1/1998 Buck et al. ..... 166/338

OTHER PUBLICATIONS

PCT International Search Report for Application Serial No. PCT/US01/49023, dated Jun. 21, 2002 (pp. 4).

* cited by examiner

*Primary Examiner*—William Neuder
(74) *Attorney, Agent, or Firm*—Conley Rose, P.C.

(57) ABSTRACT

A self-erecting rig is adapted for deployment on a platform and includes hydraulic jacks and rails. The rig structure is made up of stacked, interlocking modules having open areas pre-fitted with well equipment such as mud pumps, mud tanks, and power packs. The rails are disposed on a platform and guide the modules to the hydraulic jacks. Hydraulic jacks, also fixed onto the platform, are configured to releasably engage and elevate the modules. During deployment, the jacks engage a module and hoist it to a pre-determined height. While the engaged module is suspended, another module is slid immediately below. After the two modules interlock, the jacks repeat the process.

24 Claims, 4 Drawing Sheets

SELF-ERECTING RIG

CROSS-REFERENCE TO RELATED APPLICATIONS

The present application claims the benefit of 35 U.S.C. 111(b) provisional application Serial No. 60/256,049 filed Dec. 15, 2000, and entitled "Self-Erecting Rig", and further relates to U.S. patent application Ser. No. 09/739,072, filed Dec. 15, 2000 entitled "CT Drilling Rig" both hereby incorporated herein by reference.

STATEMENT REGARDING FEDERALLY SPONSORED RESEARCH OR DEVELOPMENT

Not Applicable.

BACKGROUND OF THE INVENTION

1. Field of the Invention

The present invention generally relates to rigs adapted to support well construction and work-over operations. More particularly, the present invention relates to self-erecting rigs. In another aspect, the present invention relates to self-erecting rigs having modular structures configured to support and house well equipment.

2. Description of the Related Art

Cost effective production of oil or gas reserves requires, in part, surface support and control systems that economically deploy drilling and completion systems and methods. Prior art drilling rigs have inherent drawbacks that reduce the cost effectiveness of utilizing drilling and completion systems to construct new wells and work over existing wells. While the drawbacks discussed below are in reference to an offshore platform, these drawbacks may also be found in other situations.

First, well operations utilizing prior art rigs tend to occupy a significant amount of deck space. Typically, floating platforms are massive structures that are designed to withstand decades of service in a harsh ocean environment. Despite the enormous overall size of these offshore platforms, the deck on a given offshore platform can become crowded with various well equipment. Because the lack of deck space may limit options in operation sequencing or selection of equipment, it is usually desirable to minimize the amount of equipment on the platform deck. Prior art rigs are deployed in conjunction with mud tanks, power packs, mud pumps, blow-out preventer accumulators, and other equipment. This equipment is usually located adjacent to the prior art rig. Thus, the rig and related equipment have a relatively large "footprint" that reduces the amount of available deck space.

Also, the erection of prior art rigs and related equipment can be time consuming and effort intensive. Prior art rigs and related equipment are usually assembled piece by piece at the offshore facility. This operation usually requires up to hundreds of individual "lifts." That is, each piece of equipment must be lifted and handled a number of times before final installation. Further, while an offshore platform may have dedicated cranes for general uses, a "leapfrog" crane is usually required to lift and handle the bulky components of the prior art rig and related equipment. Thus, construction of prior art rigs reduces the overall cost effectiveness of well activities. The present invention overcomes these and other drawbacks of the prior art.

SUMMARY OF THE PREFERRED EMBODIMENT

A preferred embodiment of the present invention includes a rig adapted for deployment on a platform and includes hydraulic jacks and rails. The rig structure includes stacked modules incorporating a self-latching mechanism to interlock adjacent modules. The modules include open areas within their structure for storing well equipment such as mud pumps, mud tanks, and power packs. This equipment is pre-fitted into the modular structures before shipment to the offshore facility. The rails are disposed on a platform and guide the modules to the hydraulic jacks. Hydraulic jacks, also fixed onto the platform, are configured to releasably engage and elevate the modules.

During deployment, a first module is placed onto the rails and trolleyed to the hydraulic jacks. The jacks, when actuated, engage the first module and hoist it to a predetermined height. A second module is then slid below the first module. The jacks then lower the first module onto the second module. As the first module seats on the second module, the self-latching mechanism locks the two modules together. Thereafter, the jacks release the first module, return to their initial position, engage the second module, and hoist the first and second modules. A third module is slid below the first and second module, and the process repeats.

Thus, the preferred embodiment comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 1:
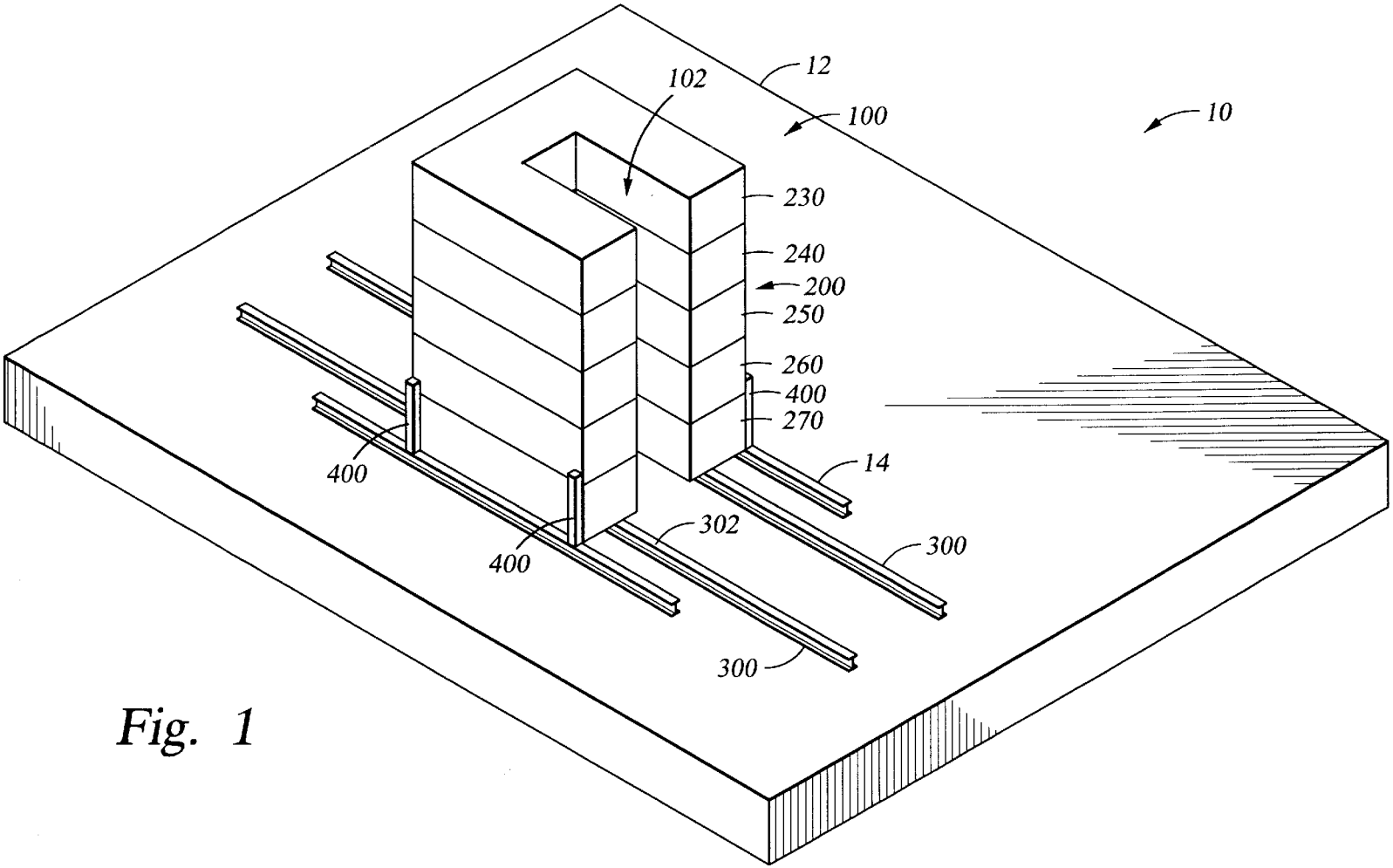
FIG. 1 is a perspective view of a preferred embodiment of a self-erecting rig.

A preferred embodiment of a rig made in accordance with the present invention may be used on a platform constructed to carry out hydrocarbon exploration and recovery operations either offshore or on land. The preferred rig facilitates the introduction of wirelines, a working string, a drill string, and other tubular umbilicals into a subterranean wellbore. The preferred rig also enables the efficient deployment and operation of bottom hole assemblies (BHAs). For simplicity, however, the embodiments of the present invention will be described with reference to an offshore drilling platform. Referring now to FIG. 1, there is shown an offshore platform 10 having a deck 12 and skids 14. Preferred rig 100, which is fixed (e.g., bolted) onto skids 14, includes modules 200, rails 300 and jacks 400. For clarity, not shown in FIG. 1 are the various equipment, facilities, and ancillary components typically found on well platforms. These items include generators, hydraulic pumps and hoses, electrical cables, data transmission wires, living quarters, storage facilities, and other equipment components and facilities that are known to those of ordinary skill in the art.

Figure 2A:
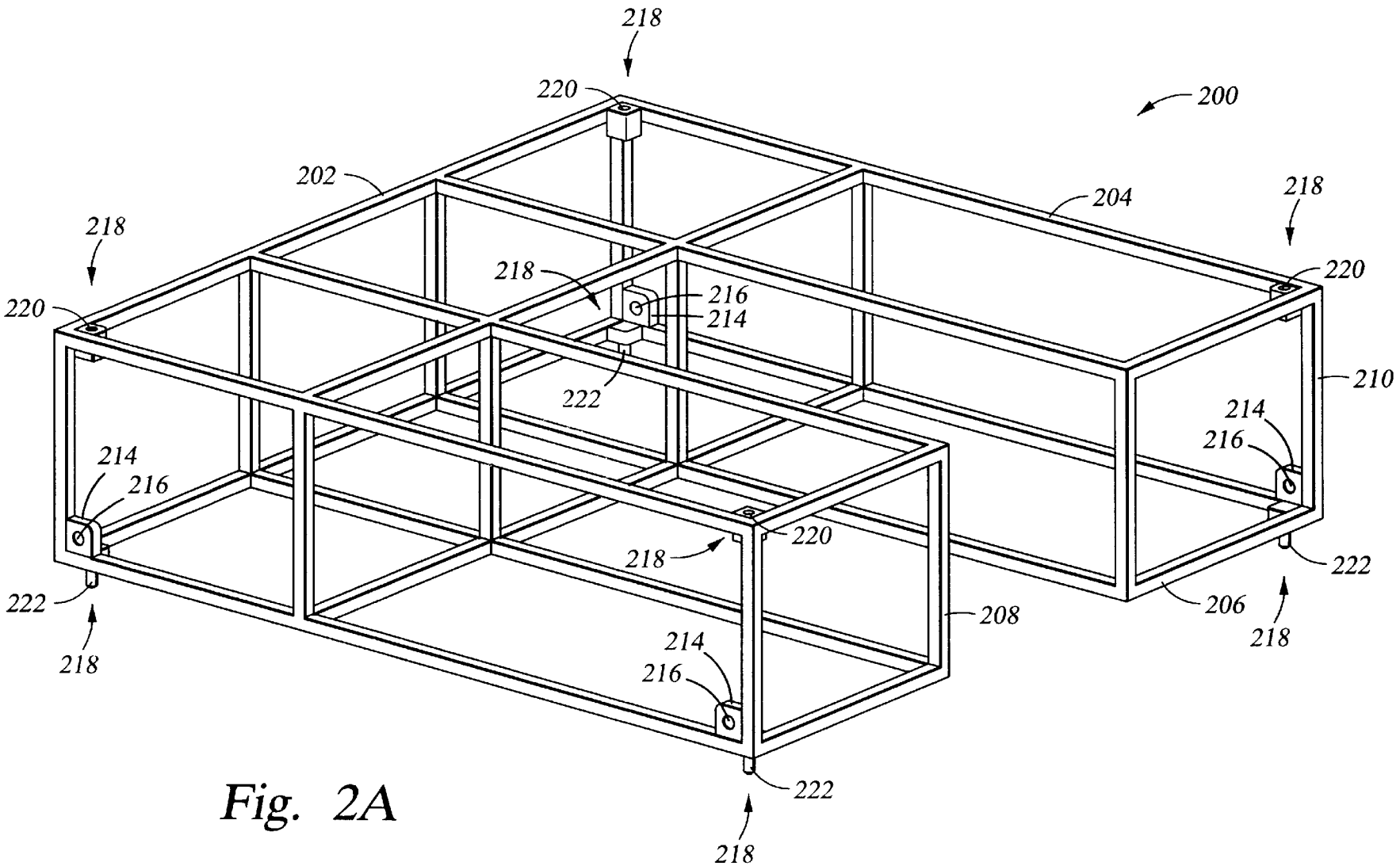
FIG. 2A is a perspective view of an embodiment of a module used in a preferred rig.

Referring now to FIG. 2A, module 200 is preferably a prefabricated standardized modular structure that can be preloaded with equipment. Module 200 has a rear frame 202, a top frame 204, a bottom frame 206, an inner frame 208, and side frames 210. An exemplary dimension of module 200 may be thirty feet by thirty feet and ten feet in height. As will be understood by one of ordinary skill in the art, module 200 may be formed of nearly any required dimension, and utilize any number of acceptable frame structures. It is preferred that the framework ultimately used provides for storage areas suitable for housing well equipment. Co-pending application U.S. application, titled "CT Drilling Rig," U.S. patent application Ser. No. 09/739,072, filed on Dec. 15, 2000 discloses embodiments of module designs and is incorporated by reference for all purposes.

Inner frame 208 defines an open shaft that forms an open throat 102 for rig 100 (FIG. 1). Inner frame 208 also provides the foundation against which well equipment, such as powered arms, may be suspended. Such equipment is described in co-pending U.S. application Ser. No. 09/739,072, titled "CT Drilling Rig." Referring now to FIG. 2B, side frames 210 are each provided with lifting pads 214. One lifting pad 214 is welded, or otherwise secured, to the bottom corners of each side frame 210. Each lifting pad 214 includes a bore 216 for interlocking with jacks 400 (FIG. 1) in a manner described below. It will be understood that lifting pads 214 may be located in any position on module 200.

Figure 2B:
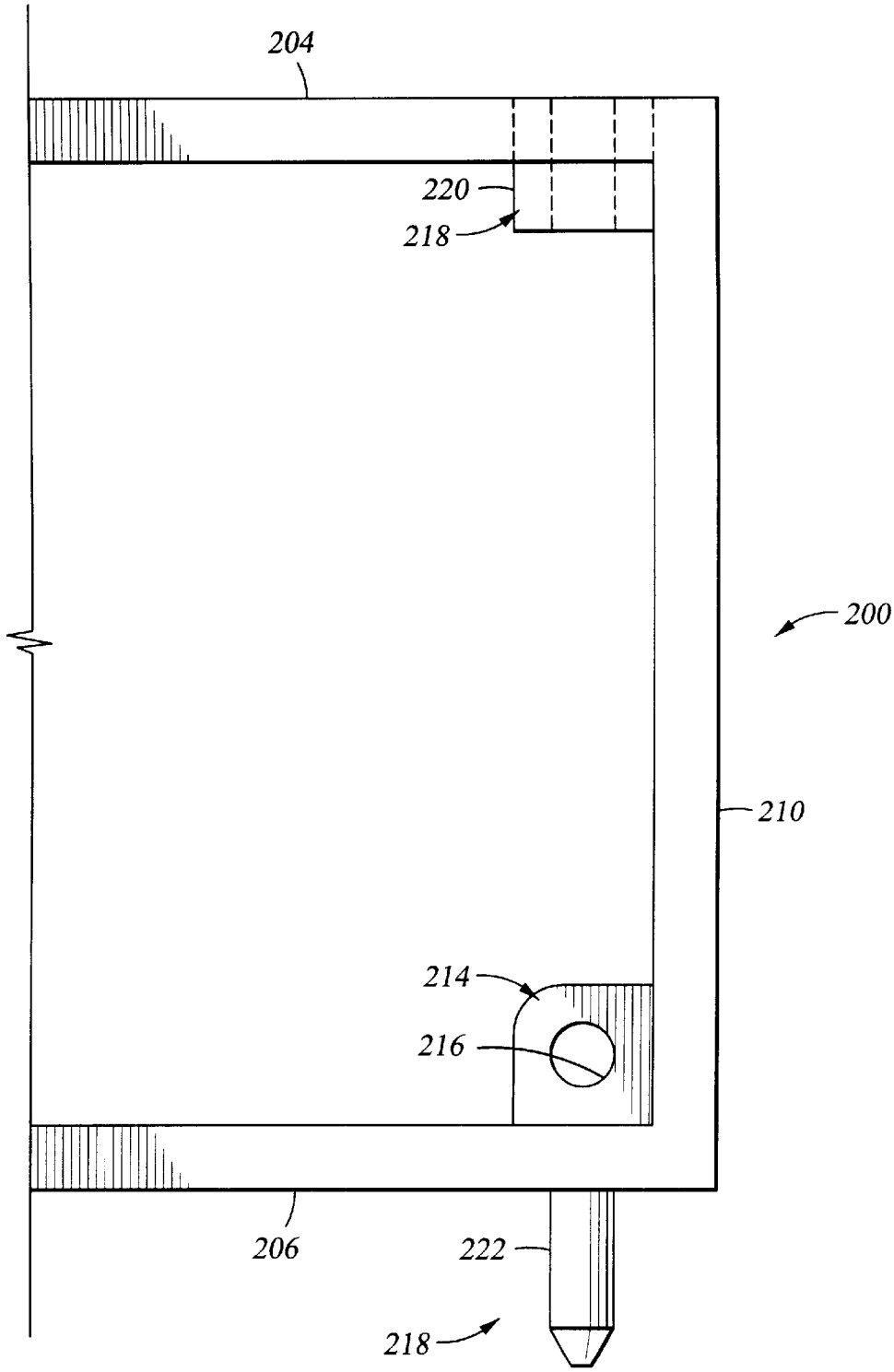
FIG. 2B is a side view of a embodiment of a module used in a preferred rig.

Referring still to FIG. 2B, module 200 also includes a self-actuating latch 218. Self-actuating latch 218 includes a female connector 220 disposed on the four out-board corners of top frame 204 and a male connector 222 disposed on the four out-board corners of bottom frame 206. Because modules 200 may be stacked, self-actuating latch 218 is preferably ISO 9000 compliant and conforms to any other applicable standards that may govern latching mechanisms used to secure vertically stacked storage containers. One exemplary latch design may use a finger as the male connector and a complementary keyed slot as the female connector. The finger may incorporate a hooked end that engages a ledge or lip in the keyed slot. In any event, one of ordinary skill in the art will recognize that any number of latch designs may be suitable.

Referring back to FIG. 2A, modules 200 incorporates open internal spaces adapted to receive well equipment. While the type of equipment may vary depending on the nature of the well A construction or work-over operation at hand, an exemplary arrangement of well equipment for module 200 is as follows. Because one of ordinary skill in the art would be familiar with the equipment described, this equipment is not shown in the figures. Referring now to FIG. 1, a first module 230 may include a monitoring cabin. The monitoring cabin may houses alarms, control panels, communication systems, and other instrumentation needed to control well construction operations and production activities. A second module 240 may be fitted with equipment and tooling, such as accumulators, to support a blow-out preventer (BOP) stack. A third module 250 may be fitted with a hydraulic power pack to support well operations. A fourth module 260 may be fitted with mud pumps. A fifth module 270 may include the mud tanks that supply the drilling fluid. All of this equipment is pre-fitted into their respective modules 200 prior to shipment to offshore platform 10. Thus, not only does module 200 act as a support structure for this equipment during well operations, module 200 acts as a storage container that facilitates the transportation and lifting and handling for well equipment.

Rails 300 provide a guide for transporting modules 200 to rig 100. Rails 300 are preferably I-beams that extend from a landing 302 into rig throat 102. Rails 300 provide a support surface that enable other lifting and handling equipment, such as a trolley, to move module 200. Alternatively, rails 300 may be modified to incorporate equipment such as pulleys, chains, rollers, or belts to independently move module 200.

Figure 3:
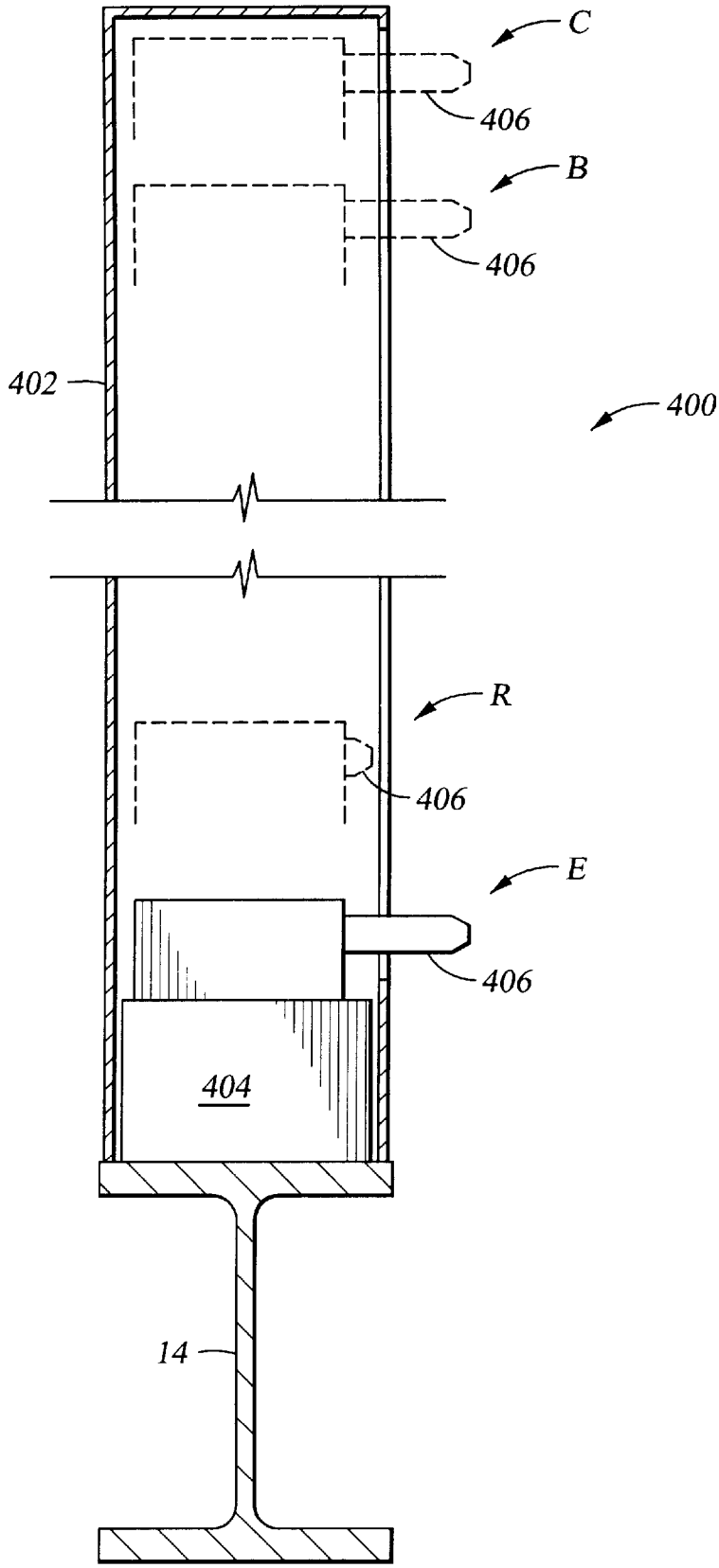
FIG. 3 is an cutaway end view of a embodiment of a lift used in a preferred rig.

Referring now to FIGS. 1 and 3, jacks 400 cooperate to hoist/lower modules 200 during rig erection/disassembly operations. Preferably, two jacks 400 are fixed to each skid 14. Greater or fewer jacks 400 may be used depending on factors such as the weight and stability of modules 200. Each jack includes a housing 402, a lift 404, and a retractable lock-rod 406. Housing 402 protects jack 400 internals from damage arising from contact with surrounding equipment and also protects rig workers from injuries occurring from unintended contact with jack 400. Hydraulic lift 404 may be a known piston-cylinder arrangement energized by pressurized hydraulic fluid. Hydraulic power is preferred to actuate lift 404 because hydraulic fluid is usually available on offshore facilities. If hydraulic fluid is not available, lift 404 may be adapted to use a different power source such as electricity. For example, an electric motor coupled to a worm gear may also be used as the lifting mechanism. Affixed to the end of lift 404 is retractable lock-rod 406. Lock-rod 406, when actuated, moves between an extended position, designated as "E," and a retracted position, designated as "R." Actuation may be accomplished by known hydraulic circuits or by known electro-mechanical means. In the extended position "E," lock-rod 406 enters bore 216 of lifting pad 214 (FIG. 2B). It will be understood that any number of engagement mechanisms may be used in lieu of lock-rod 406 and lifting pad 214 (FIG. 2B). For example, lifting pad 214 may be eliminated by using a retractable pallet (not shown) instead of lock-rod 406. The retractable pallet would simply form a support surface on which module bottom frame 206 (FIG. 2A) would rest.

Referring now to FIG. 3, lift 404 preferably elevates module 200 at least the height of module 200 plus some additional clearance distance. For example, for a module height of ten feet, lift 404 elevates module 200 (FIG. 1) about twelve feet. That is, lift 404, in this example, has a stroke of about twelve feet. Lift 404 also has three static positions, designed as "A," "B." and "C." Static position "A" represents the lowest pre-elevated position of lift 404. Lift 404, shown in phantom, takes static position "C" at the full stroke distance. Lift 404, also shown in phantom, enters static position "B" when setting one module 200 onto another module 200 below.

In a preferred deployment of the above-described embodiment, each of the modules 200 are fitted with a specific piece of equipment, e.g., mud tanks, mud pumps, hydraulic power packs, a BOP accumulators, and monitoring stations. Transport vehicles, such as barges, transport each of these modules to the offshore facility. The cranes of the offshore facility, in a succession of lifts, move each of modules 200 from the transport vehicle to, ultimately, the landing 302 of the rails 300. For each module 200, the following subsequent steps are taken. A trolley moves the module 200 along the rails 300 and into the rig throat 102. Once the module lifting pads 214 are aligned to the jacks 400, the lock-rods 406, when actuated, move to their extended position "E" and engage the module lifting pads 214. The module 200 now secured in the jacks 400 is hoisted from position "A" to position "C." With this module 200 suspended in position "C," another module 200 is slid into the rig throat 102. After verifying that the male and female latching mechanisms 218 of the two modules are aligned, the suspended module 200 is lowered from position "C" to position "B." As the suspended module 200 reaches position "B," the male and female latching mechanisms 218 engage. Once the stability of the two modules 200 is verified, the lock-rods 406 return to their retracted position "R" and return to position "A." Thereafter, the lock-rods 406 engage the lower module and lift both modules. When the lifts reach position "C," the above steps are repeated for successive modules. Once all the modules are in place, the necessary connections are made up and additional equipment may be affixed onto the rig as needed.

Thus, it can be seen that the preferred rig can be constructed without need of a specialized cranes and with minimal manual intervention. It can also be seen that equipment that would otherwise occupy the deck of the offshore platform is now stored within the preferred rig 100 itself. Thus, the relatively small "footprint" of the preferred rig 100 frees up valuable deck space for other offshore activities. Moreover, this small "footprint" enables the preferred rig 100 to be deployed in a greater number of offshore platforms. Also, it is contemplated that the preferred rig 100 may be fitted with sensors, video cameras, remote controls, and other systems than can enable a nearly automated erection of the rig 100. Moreover, because of the modular nature of the rig 100, the jacking mechanism and the pre-installation of the equipment into the modules, the preferred rig 100 can be contructed in a much shorter time than a prior art rig.

While a preferred embodiment of this invention has been shown and described, modifications thereof can be made by one skilled in the art without departing from the spirit or teaching of this invention. The embodiment described herein is exemplary only and is not limiting. Many variations and modifications of the system and apparatus are possible and are within the scope of the invention. Accordingly, the scope of protection is not limited to the embodiment described herein, but is only limited to the claims that follow, the scope of which shall include all equivalents of the subject matter of the claims.

What is claimed is:

1. A rig apparatus for drilling a well comprising:

a plurality of modular structures;

a set of rails, the modular structures being moveable on the set of rails from a first position to a second position; and at least one hydraulic jack for raising at least one of the plurality of modular structures, at least one other of the plurality of modular structures being inserted underneath the raised modular structures such that the modular structures are stacked adjacent to one another.

2. The rig apparatus of claim 1 wherein each of the plurality of modular structures each further comprises:

a top frame, a rear frame, a bottom frame, an inner frame, and multiple side frames such that the frames form open internal spaces.

3. The rig apparatus of claim 2 wherein the open internal spaces are adapted to receive well equipment.

4. The rig apparatus of claim 3 wherein the well equipment includes but is not limited to one or more of the following group: monitoring cabin, accumulators, hydraulic power pack, mud pump, or mud tank.

5. The apparatus of claim 1 wherein each of the plurality of modular structures further comprises at least one lifting pad.

6. The apparatus of claim 5 wherein the at least one lifting pad includes a bore for engagement with the hydraulic jack.

7. The apparatus of claim 5 wherein the at least one hydraulic jack further includes:

a housing;

a lift; and a retractable lock-rod for engaging the lifting pad on the plurality of modular structures.

8. The apparatus of claim 2 wherein each of the plurality of modular structures further comprises:

outer corners on the top frame;

outer corners on the bottom frame;

female connectors, one on each of the outer corners of the top frame; and male connectors, one on each of the outer corners of the bottom frame and matching up to the female connectors such that the male connectors on one modular structure releasably engage the female connectors on another modular structure.

9. A rig apparatus for drilling a well comprising:

a plurality of modular structures;

a means for transporting the modular structures from a first position to a second position; and a means for raising at least one of the plurality of modular structures, at least one other of the plurality of modular structures being inserted underneath the raised modular structures such that the modular structures are stacked adjacent to one another in the second position.

10. The apparatus of claim 9 wherein the means for transporting the modular structures comprises a set of rails.

11. The apparatus of claim 10 wherein the rails have an I-beam cross-section.

12. The apparatus of claim 9 wherein each of the plurality of modular structures further comprises:

a top frame, a rear frame, a bottom frame, an inner frame, and multiple side frames such that the frames form open internal spaces.

13. The rig apparatus of claim 12 wherein the open internal spaces are adapted to receive well equipment.

14. The rig apparatus of claim 13 wherein the well equipment includes but is not limited to one or more of the following group: monitoring cabin, accumulators, hydraulic power pack, mud pump, or mud tank.

15. The apparatus of claim 9 wherein each of the plurality of modular structures further comprises a means for engaging the means for raising the modular structures.

16. The apparatus of claim 15 wherein the means for engaging the means for raising the modular structures includes at least one lifting pad with a bore.

17. The apparatus of claim 9 wherein the means for raising the modular structures includes at least one hydraulic jack.

18. The apparatus of claim 17 wherein the hydraulic jack further comprises:

a housing;

a lift; and a retractable lock-rod for engaging the bore of the lifting pad on the plurality of modular structures.

19. The apparatus of claim 12 wherein each of the plurality of modular structures further comprises a means for releasingly engaging the adjacent modular structure.

20. The apparatus of claim 19 wherein the means for releasingly engaging the adjacent modular structure comprises:

outer corners on the top frame;

outer corners on the bottom frame;

female connectors, one on each of the outer corners of the top frame; and male connectors, one on each of the outer corners of the bottom frame and matching up to the female connectors such that the male connectors on one modular structure releasably engage the female connectors on another modular structure.

21. A structure for drilling a well, comprising:

a first frame;

a lifting member releasably attached to said first frame to raise said first frame;

a second frame; and a moving member, the second frame being moveable underneath the first frame by the moving member.

22. The structure of claim 21 further including a lock member to lock said first and second frames.

23. A method for erecting a rig structure, comprising:

raising a first frame;

moving a second frame underneath said first frame; and lowering said first frame onto said second frame.

24. The method of claim 23 further including:

raising said first and second frames;

moving a third frame underneath said first and second frames; and lowering said first and second frames onto said third frames.

* * * * *